US007789541B2

(12) United States Patent
Meng et al.

(10) Patent No.: US 7,789,541 B2
(45) Date of Patent: Sep. 7, 2010

(54) METHOD AND SYSTEM FOR LAMP TEMPERATURE CONTROL IN OPTICAL METROLOGY

(75) Inventors: Ching-Ling Meng, Sunnyvale, CA (US); Mihail Mihaylov, San Jose, CA (US)

(73) Assignee: Tokyo Electron Limited, Tokyo (JP)

( * ) Notice: Subject to any disclaimer, the term of this patent is extended or adjusted under 35 U.S.C. 154(b) by 201 days.

(21) Appl. No.: 12/059,610

(22) Filed: Mar. 31, 2008

(65) Prior Publication Data

US 2009/0244910 A1 Oct. 1, 2009

(51) Int. Cl.
*F21V 29/00* (2006.01)
*H01J 13/14* (2006.01)

(52) U.S. Cl. ..... 362/373; 362/294; 362/218; 362/276; 315/112

(58) Field of Classification Search ..... 362/373, 362/294, 218, 547; 347/101, 18; 315/112, 315/117, 118
See application file for complete search history.

(56) References Cited

U.S. PATENT DOCUMENTS

| | | | | |
|---|---|---|---|---|
| 4,734,835 | A | 3/1988 | Vines | |
| 5,420,769 | A | 5/1995 | Ahlgren | |
| 5,585,832 | A * | 12/1996 | Orimoto et al. | 347/175 |
| 6,616,304 | B2 * | 9/2003 | Li | 362/302 |
| 6,621,239 | B1 * | 9/2003 | Belliveau | 315/312 |
| 6,635,999 | B2 * | 10/2003 | Belliveau | 315/149 |
| 7,038,390 | B2 * | 5/2006 | Swami et al. | 315/112 |
| 2004/0233675 | A1 * | 11/2004 | Meguro et al. | 362/373 |

* cited by examiner

*Primary Examiner*—Ali Alavi

(57) ABSTRACT

A method and system are provided for lamp temperature control for optical metrology. Precise control of the lamp temperature provides the improved signal-to-noise ratios required for accurately determining the profile of nanometer sized structures using optical metrology.

16 Claims, 10 Drawing Sheets

METHOD AND SYSTEM FOR LAMP TEMPERATURE CONTROL IN OPTICAL METROLOGY

FIELD OF THE INVENTION

The invention relates to optical metrology systems that measure profiles of structures on a workpiece, and more particularly to improving signal-to-noise ratio of an illumination beam through lamp temperature control.

BACKGROUND OF THE INVENTION

Optical metrology involves directing an incident illumination beam at a structure on a workpiece, measuring the resulting diffraction signal, and analyzing the measured diffraction signal to determine various characteristics of the structure. The workpiece can be a wafer, a substrate, or a magnetic medium. In manufacturing of the workpieces, periodic gratings are typically used for quality assurance. For example, one typical use of periodic gratings includes fabricating a periodic grating in proximity to the operating structure of a semiconductor chip. The periodic grating is then illuminated with electromagnetic radiation in the illumination beam. The electromagnetic radiation that deflects off of the periodic grating is collected as a diffraction signal. The diffraction signal is then analyzed to determine whether the periodic grating, and by extension whether the operating structure of the semiconductor chip, has been fabricated according to specifications.

In one conventional optical metrology system, the diffraction signal collected from illuminating the periodic grating (the measured diffraction signal) is compared to a library of simulated diffraction signals. Each simulated diffraction signal in the library is associated with a hypothetical profile. When a match is made between the measured diffraction signal and one of the simulated diffraction signals in the library, the hypothetical profile associated with the simulated diffraction signal is presumed to represent the actual profile of the periodic grating. The hypothetical profiles, which are used to generate the simulated diffraction signals, are generated based on a profile model that characterizes the structure to be examined. Thus, in order to accurately determine the profile of the structure using optical metrology, a profile model that accurately characterizes the structure should be used.

Further, in order to accurately determine the profile of structures of ever decreasing size found in semiconductor devices, there is a great need to reduce signal-to-noise ratios in optical metrology systems. This will further allow for meeting the requirement for increased throughput and lower cost of ownership.

SUMMARY OF THE INVENTION

A method and apparatus are provided for lamp temperature control in optical metrology. Precise control of the lamp temperature provides improved signal-to-noise ratios that are required for accurately determining the profile of nanometer sized structures in optical metrology.

According to one embodiment of the invention, a lamp temperature control system for an optical metrology system is provided. The lamp temperature control system contains an enclosure surrounding a lamp housing; a lamp disposed in the lamp housing; where the lamp housing dissipates heat from the lamp; a cooling device for cooling the lamp housing; a temperature sensor coupled to the lamp housing for measuring the temperature of the lamp housing; and a controller for controlling the cooling device to maintain the temperature of the lamp housing in a narrow temperature range during operation of the lamp.

According to another embodiment of the invention, a method is provided for controlling lamp temperature in an optical metrology system. The method includes measuring temperature of a lamp housing containing a lamp using a temperature sensor coupled to the lamp housing; cooling the lamp housing using a cooling device; and controlling the cooling device to maintain the temperature of the lamp housing in a narrow temperature range during operation of the lamp.

DETAILED DESCRIPTION OF SEVERAL EMBODIMENTS OF THE INVENTION

A method or apparatus are provided for controlling temperature of an lamp used to form an illumination beam for optical metrology. One skilled in the relevant art will recognize that the various embodiments may be practiced without one or more of the specific details, or with other replacement and/or additional methods, materials, or components. In other instances, well-known structures or operations are not shown or described in detail to avoid obscuring aspects of various embodiments of the invention. Similarly, for purposes of explanation, specific numbers, and configurations are set forth in order to provide a thorough understanding of the invention. Nevertheless, the invention may be practiced without specific details. Furthermore, it is understood that the various embodiments shown in the figures are illustrative representations and are not necessarily drawn to scale.

Reference throughout this specification to "one embodiment" or "an embodiment" means that a particular feature, structure, material, or characteristic described in connection with the embodiment is included in at least one embodiment of the invention, but do not denote that they are present in every embodiment. Thus, the appearances of the phrases "in one embodiment" or "in an embodiment" in various places throughout this specification are not necessarily referring to the same embodiment of the invention.

Various operations will be described as multiple discrete operations in turn, in a manner that is most helpful in understanding the invention. However, the order of description should not be construed as to imply that these operations are necessarily order dependent. In particular, these operations need not be performed in the order of presentation. Operations described may be performed in a different order than the described embodiment. Various additional operations may be performed and/or described operations may be omitted in additional embodiments.

Figure 1:
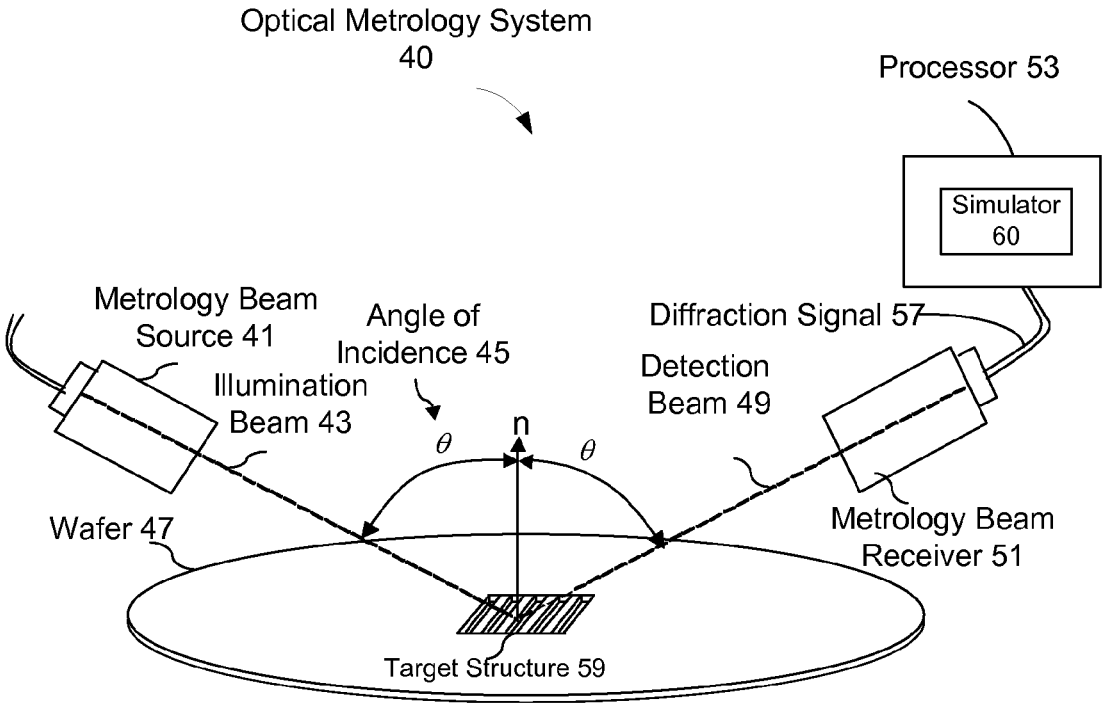
FIG. 1 is an architectural diagram illustrating an exemplary embodiment where an optical metrology system can be utilized to determine the profiles of structures formed on a semiconductor wafer.

FIG. 1 is an architectural diagram illustrating an exemplary embodiment where optical metrology can be utilized to determine the profiles or shapes of (patterned) structures fabricated on a semiconductor wafer. In order to facilitate the description of the present invention, a semiconductor wafer is utilized to illustrate an application of the concept. The methods and apparatus described equally apply to other workpieces that have repeating structures. The workpiece may be a wafer, a substrate, disk, or the like.

In FIG. 1, an optical metrology system 40 includes a metrology beam source 41 projecting a metrology illumination beam 43 at a target structure 59 of a wafer 47. The metrology beam source 41 contains one or more light sources (lamps), for example a Xenon (Xe) lamp, a deuterium ($D_2$) lamp, or both. According to embodiments of the invention, the metrology beam source 41 may contain an ultraviolet (UV) lamp configured for emitting ultraviolet (UV) electromagnetic radiation, a lamp configured for emitting visible electromagnetic radiation, or a combination thereof. However lamps emitting electromagnetic radiation having wavelengths greater or smaller than ultraviolet (UV) or visible electromagnetic radiation may also be used. The metrology illumination beam 43 is projected at an incidence angle theta (θ) 45 towards the target structure 59. The diffracted detection beam 49 is measured by a metrology beam receiver 51. A measured diffraction signal 57 is transmitted to a processor 53. The processor 53 compares the measured diffraction signal 57 against a simulator 60 of simulated diffraction signals and associated hypothetical profiles representing varying combinations of critical dimensions of the target structure and resolution. The simulator can be either a library that consists of a machine learning system, pre-generated data base and the like (i.e., a library method), or on demand diffraction signal generator that solves the Maxwell equation for a giving profile (i.e., a regression method). In one exemplary embodiment, the diffraction signal generated by the simulator 60 best matching the measured diffraction signal 57 is selected. The hypothetical profile and associated critical dimensions of the selected simulator 60 instance are assumed to correspond to the actual cross-sectional shape and critical dimensions of the features of the target structure 59. The optical metrology system 40 may utilize a reflectometer, an ellipsometer, or other optical metrology device to measure the diffraction beam or signal. An optical metrology system is described in U.S. Pat. No. 6,913,900, entitled GENERATION OF A LIBRARY OF PERIODIC GRATING DIFFRACTION SIGNAL, issued on Sep. 13, 2005, which is incorporated herein by reference in its entirety.

Figure 3:
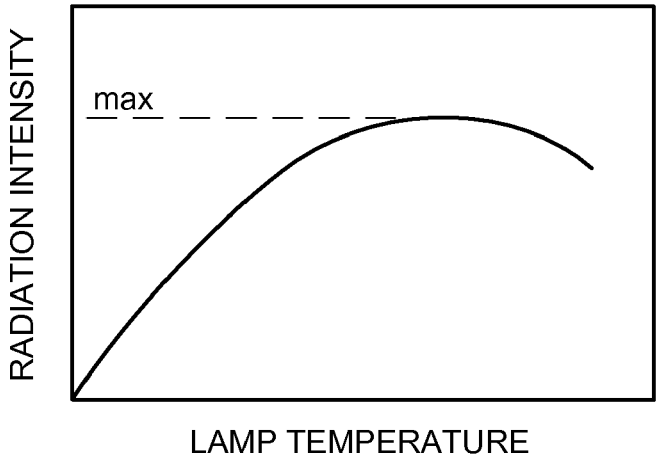
FIG. 3 is a graph illustrating a relationship between temperature of a lamp and radiation intensity thereof.

The metrology beam source 41 may contain a tubular lamp for projecting metrology illumination beam 43. For example, ultraviolet (UV) lamps typically generate a large amount of heat that must be dissipated from the lamps and radiation intensities of ultraviolet (UV) lamps typically change with lamp temperature. In general, if the tube temperature is lower, then the radiation intensity is lower; if the tube temperature rises, then the radiation intensity is raised; and when the tube temperature is extremely high, then the radiating intensity decreases. This is schematically shown in FIG. 3. Ultraviolet (UV) lamps are commercially available and many ultraviolet (UV) lamp manufactures recommend a wide range of operating tube temperatures. In one example, recommended operating tube temperatures may range from about 160° C. to about 200° C.

In order to provide near constant radiation intensity for optical metrology, it is necessary to keep the lamp temperature nearly constant and in a narrow temperature range. The temperature range can, for example, be less than 1° C., less than 0.5° C., less than 0.2° C., or even less than 0.1° C. Prior designs of lamp temperature control systems conventionally provide simple ways of cooling a lamp to prevent overheating. The most common method to accomplish lamp cooling includes flowing air over or through the lamp or a lamp housing containing the lamp. In these lamp temperature control system designs, airflow from an electric fan is provided by powering the electric fan using a fixed current and voltage. Therefore, since no feed-back is provided, the temperature of the lamp and the lamp housing may drift over time, and the electromagnetic radiation intensity and signal-to-noise ratio of the electromagnetic radiation may vary over time instead of being stabilized in a particular narrow temperature range.

The current inventors have realized that precise control of lamp temperature using a feed-back controlled lamp temperature control system is needed in optical metrology in order to accurately determine the profile of structures of ever decreasing size found in semiconductor devices. Simple breadboard test experiments showed that the signal-to-noise ratio of emitted ultraviolet (UV) electromagnetic radiation is closely related to fluctuations in lamp temperature. Embodiments of the invention include a lamp temperature control system that provides improved signal-to-noise ratios in the emitted electromagnetic radiation to accurately determine the profile of the very small structures (e.g., critical dimensions of structures found in 32 nm technology node, 22 nm technology node, or even smaller dimensions).

Figure 2A:
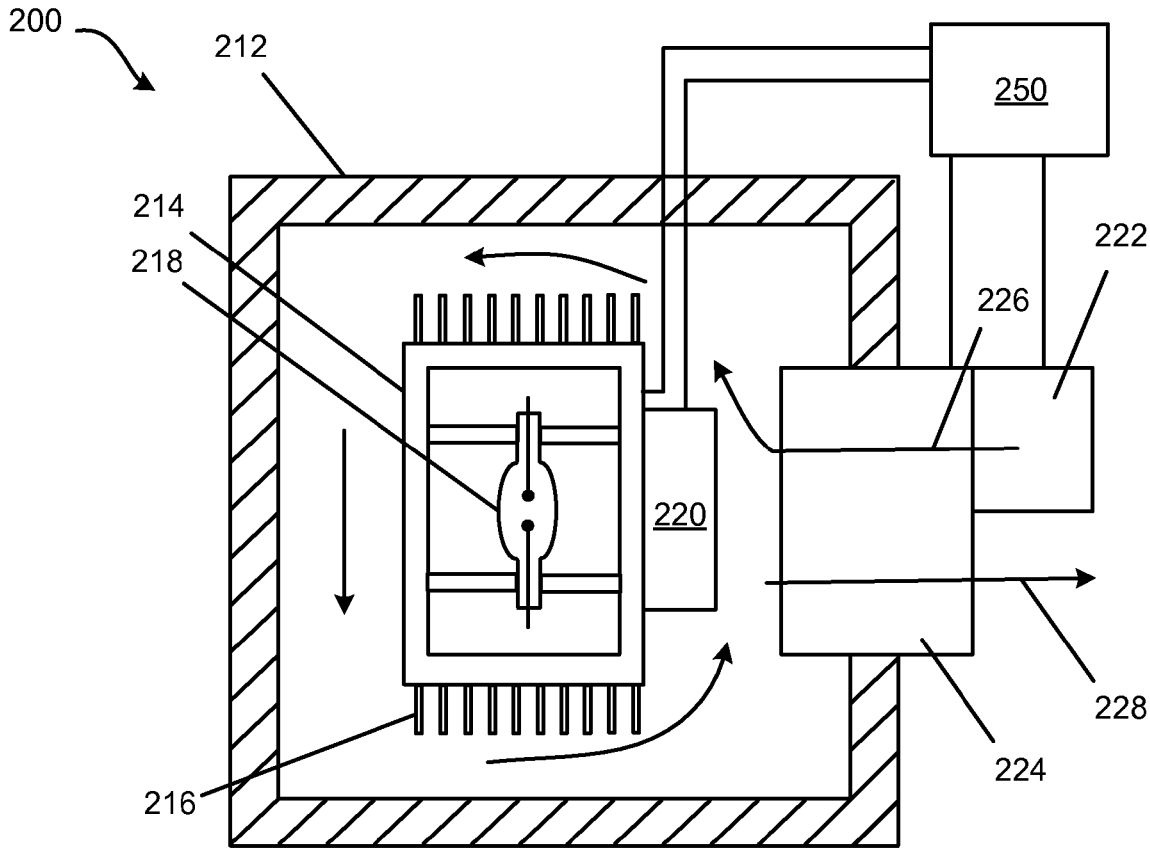
FIGS. 2A-2H schematically show a cross-sectional views of lamp temperature control systems for an optical metrology system according to embodiments of the invention.

FIG. 2A schematically shows a cross-sectional view of a lamp temperature control system for an optical metrology system according to an embodiment of the invention. The lamp temperature control system 200 may form a portion of the metrology beam source 41 depicted in FIG. 1. The lamp temperature control system 200 contains an enclosure 212, a lamp housing 214 inside the enclosure 212, and an lamp 218 in the lamp housing 214 for providing radiation for the metrology illumination beam 43 depicted in FIG. 1. The 218 may be a Xe lamp or a $D_2$ lamp and may have a tubular shape. Other embodiments may include simultaneous use of a plurality of lamps, for example one or more Xe lamps and one or more $D_2$ lamps. The lamp housing 214 is physically attached and thermally coupled to the lamp 218 to efficiently dissipate heat from the lamp 218. According to the embodiment depicted in FIG. 2A, the lamp housing 214 further contains a plurality of cooling fins 216 physically attached and thermally coupled to the lamp housing 214 or machined from the solid material forming the lamp housing 214. According to another embodiment, the plurality of cooling fins 216 may be omitted.

A temperature sensor 220 is physically attached and thermally coupled to the lamp housing 214 to enable accurate temperature measurements of the lamp housing 214. The temperature sensor 220 may be coupled to any portion of the lamp housing 214, for example to the body of the lamp housing 214 as schematically depicted in FIG. 2A. Alternatively, the temperature sensor 220 may be coupled to one or more of the cooling fins 216 or imbedded in the lamp housing 214. Those skilled in the art will readily appreciate that the temperature sensor 220 may be coupled to the lamp housing 214 using other configurations. The temperature sensor 220 can, for example, contain a thermocouple. According to one embodiment of the invention, a plurality of temperature sensors 220 may be coupled to the lamp housing 214 for measuring the temperature at multiple locations on the lamp housing 214.

The lamp temperature control system 200 further contains a variable cooling fan 222 configured for providing constant or variable airflow 226 into the enclosure 212. According to an embodiment of the invention, the variable cooling fan 222 is a component of a cooling device for controlling the temperature of the lamp housing 214. In one example, the airflow 226 from the variable cooling fan 222 may be varied (increased or decreased) by varying the current and voltage used to power the variable cooling fan 222.

The embodiment depicted in FIG. 2A further includes an air duct 224 as a component of the cooling device. The airduct fluidly connects the variable cooling fan 222 to the interior volume of the enclosure 212. The air duct 224 is configured for providing airflow 226 from the variable cooling fan 222 into the enclosure 212, where the airflow 226 flows over the lamp housing 214 and cooling fins 216. The air duct 224 is further configured for providing return airflow 228 from the enclosure 212. According to one embodiment of the invention, the (air) conductance of the air duct 224 may be varied to control the airflow 226 entering the enclosure 212 and airflow 228 exiting the enclosure 212. As used herein, conductance refers to air flow rate generated by a unitary change in gas pressure. For example, the conductance of the air duct 224 may be mechanically varied by increasing or decreasing one or more openings in the air duct 224 between the enclosure 212 and the variable cooling fan 222. According to yet another embodiment, the variable cooling fan 222 is designed to provide variable airflow 226, and the conductance of the air duct 224 may be varied to control the airflow 226 entering the enclosure 212 and the airflow 228 exiting the enclosure 212. According to one embodiment of the invention, the air duct 224 may be a simple opening in the enclosure 212 with a constant conductance for the airflows 226 and 228.

The lamp temperature control system 200 further contains a controller 250 coupled to the lamp housing 214, the temperature sensor 220, the variable cooling fan 222, and the air duct 224. Although not shown, the controller 250 may also control the lamp 218. The controller 250 can be configured to provide control data to and receive status data from the lamp housing 214 and the lamp 218, the temperature sensor 220, the variable cooling fan 222, and the air duct 224. Further, the controller 250 may be coupled to another control system (not shown), and can exchange information with the other control system. For example, the controller 250 can comprise a microprocessor, a memory (e.g., volatile or non-volatile memory), and a digital I/O port capable of generating control voltages sufficient to communicate and activate inputs to the lamp temperature control system 200 as well as monitor outputs from the lamp temperature control system 200. Moreover, the controller 250 can exchange information with the abovementioned components of the lamp temperature control system 200, and a program stored in the memory can be utilized to control the abovementioned components of the lamp temperature control system 200 according to status data received from the components. In addition, the controller 250 can be configured to analyze the status data, to compare the status data with predetermined threshold values or historical status data, and to use the comparison to change system component settings.

Figure 4:
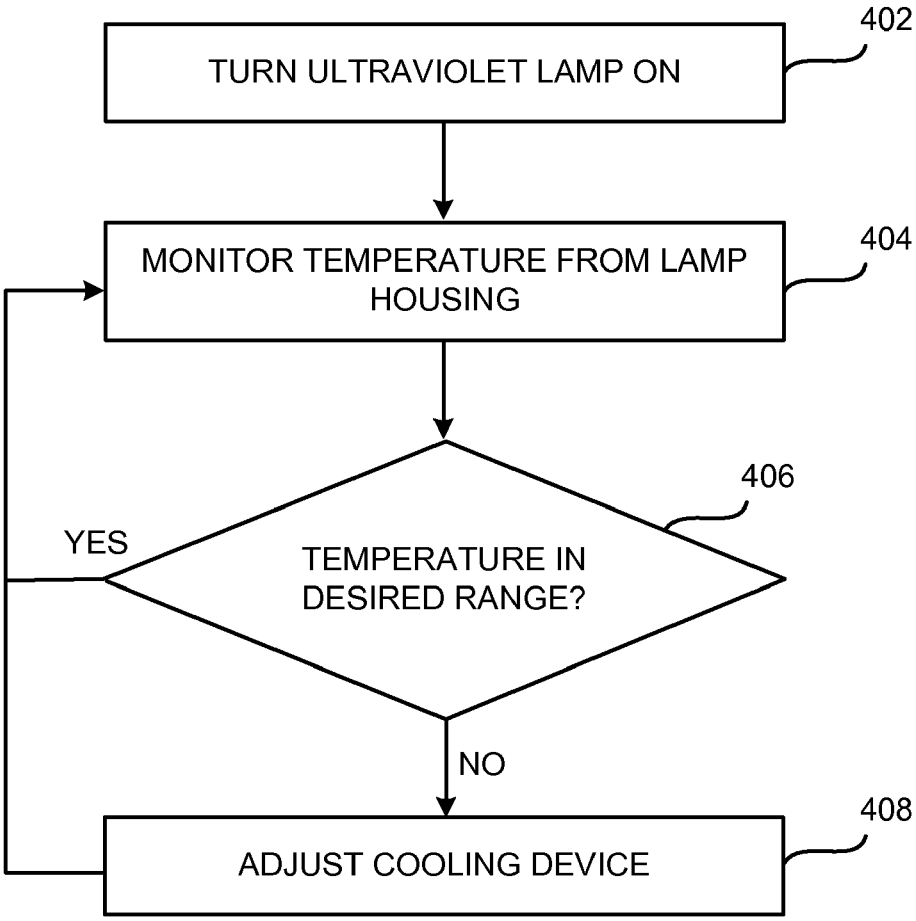
FIG. 4 is a flow diagram for controlling lamp temperature in an optical metrology system according to an embodiment of the invention.

FIG. 4 is a flow diagram for controlling lamp temperature in an optical metrology system according to an embodiment of the invention. In block 402, the lamp is turned on. Also referring to FIG. 2A, in block 404, the controller 250 monitors the temperature of the lamp housing 214 using temperature sensor 220. As those skilled in the art will readily, recognize, the measured temperature of the lamp housing 214 is proportional to the temperature of the lamp 218.

In block 406, the controller 250 compares the monitored temperature of the lamp housing 214 to a predetermined lamp housing temperature range that provides a signal-to-noise ratio of the emitted electromagnetic radiation suitable for accurately determining the profile of nanometer sized structures in optical metrology. The predetermined lamp housing temperature may be determined for each lamp using routine experimentation where signal-to-noise ratio of the electromagnetic radiation is correlated with the lamp house temperature. In block 406, if the monitored temperature is outside the desired temperature range, e.g., higher than temperatures in the desired temperature range, the cooling device is adjusted to bring the lamp house temperature to within the desired temperature range. According to embodiments of the invention, the cooling device may be adjusted by controlling the speed of the variable cooling fan 222, controlling the conductance of the air duct 224, or controlling both the speed of the variable cooling fan 222 and the conductance of the air duct 224. Since the cooling of the lamp housing 214 is actively controlled, the temperature of the lamp housing 214 and the temperature of the lamp 218 can be stabilized in a predetermined temperature range.

Figure 2B:
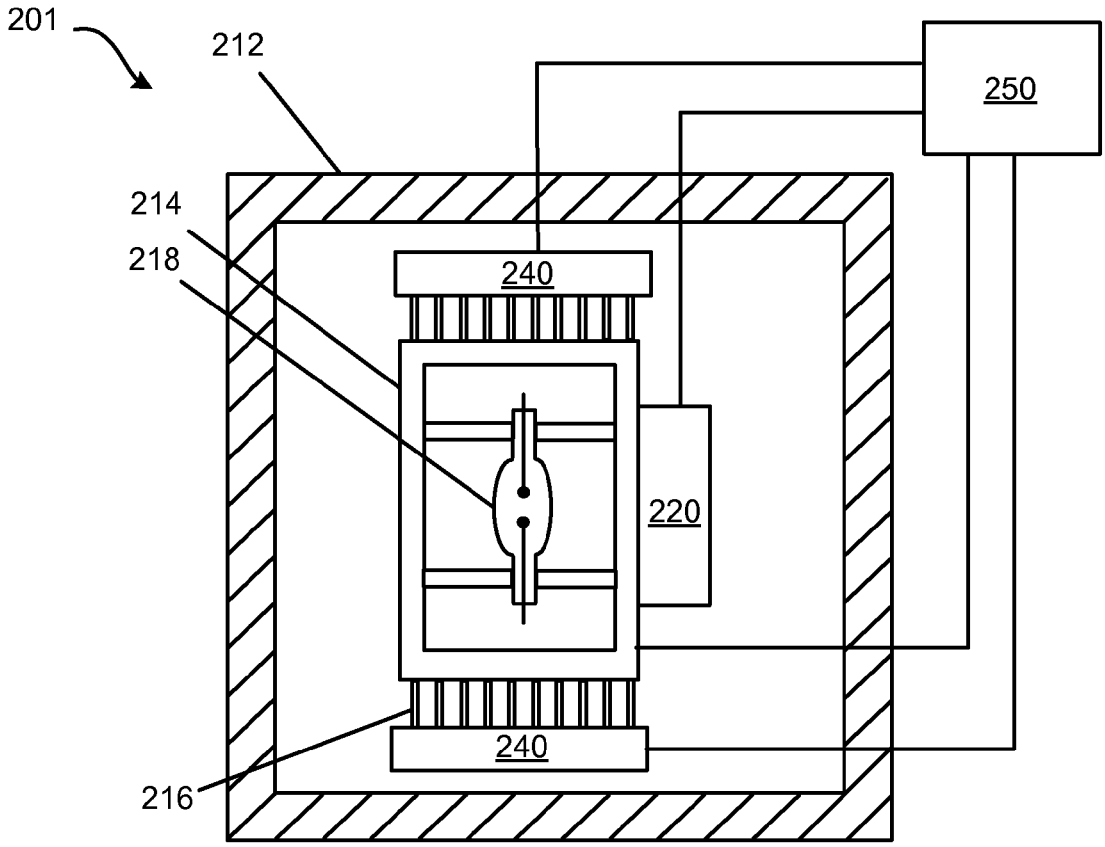

FIG. 2B schematically shows a cross-sectional view of a lamp temperature control system for an optical metrology system according to another embodiment of the invention. The lamp temperature control system 201 is similar to the lamp temperature control system 200 described in FIG. 2A but contains a thermoelectric (TE) cooler 240 that is a component of a cooling device for controlling the temperature of the lamp housing 214 during operation of the lamp 218. In the embodiment depicted in FIG. 2B, the TE cooler 240 is physically attached and thermally coupled to the cooling fins 216 to control the temperature of the lamp housing 214. Those skilled in the art will readily appreciate that the TE cooler 240 may be physically attached to the lamp housing 214 using other configurations. For example, the TE cooler 240 may be physically coupled the body of the lamp housing 214 away from the cooling fins 216 or imbedded in the lamp housing 214. In the embodiment depicted in FIG. 2B, the TE cooler 240 removes heat from the lamp housing 214 to the interior volume of the enclosure 212.

Thermoelectric (TE) coolers, sometimes called thermoelectric modules or Peltier coolers, are semiconductor-based electronic components that function as small heat pumps. By applying a low voltage direct current (DC) power source to a TE cooler, heat is moved through the TE cooler from one side of the TE cooler to the other of the TE cooler. Therefore, one side of the TE cooler will be cooled while the opposite side is simultaneously heated. This phenomenon may be reversed by changing the of the applied DC voltage. This makes TE coolers highly suitable for precise temperature control applications, both heating and cooling applications. TE coolers are commercially available, for example from Melcor, Trenton, N.J., USA.

According to one embodiment of the invention, the cooling device contains TE cooler 240 and the controller 250 is configured for monitoring the temperature of the lamp housing 214 using the temperature sensor 220, and the controller 250 can vary the DC power applied to the TE cooler 240 to maintain the temperature of the lamp housing 214 in a predetermined temperature range.

Figure 2C:
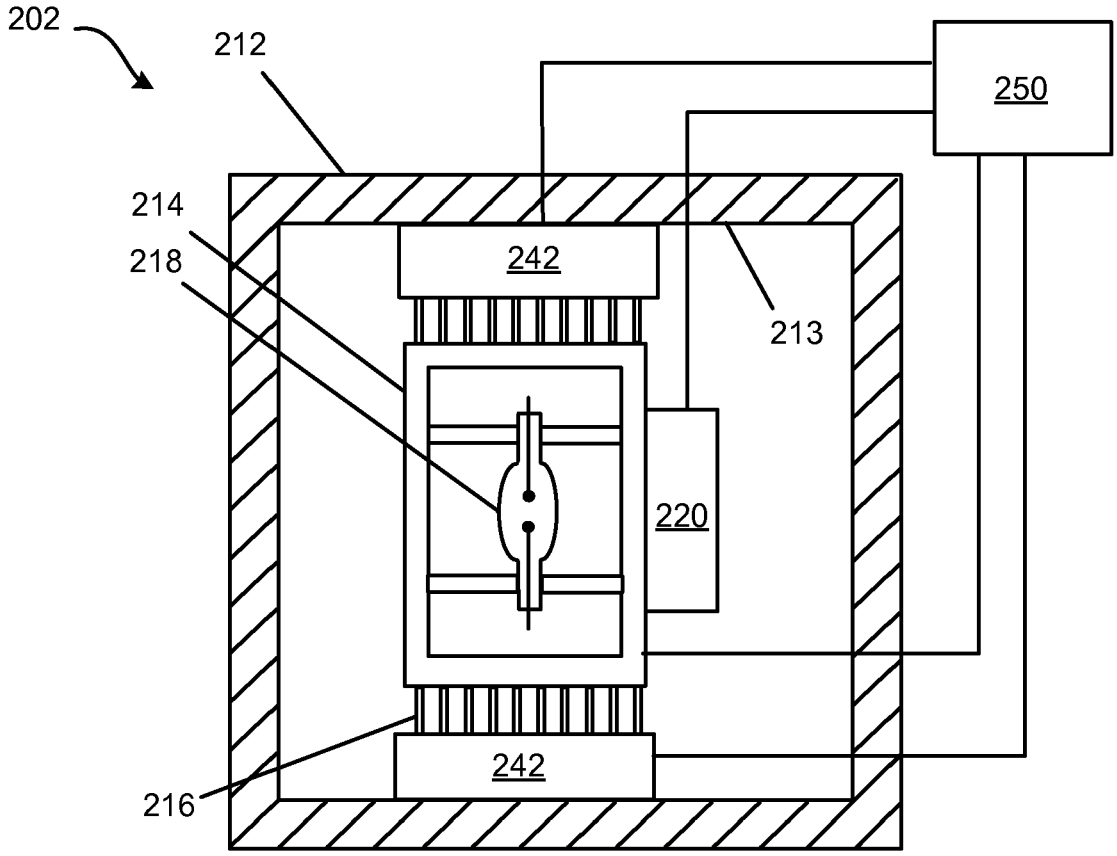

FIG. 2C schematically shows a cross-sectional view of a lamp temperature control system for an optical metrology system according to yet another embodiment of the invention. In the lamp temperature control system 202 depicted in FIG. 2C, a TE cooler 242 is physically attached and thermally coupled to the cooling fins 216 and to an inside surface 213 of the enclosure 212 to control the temperature of the lamp housing 214. The TE cooler 242 removes heat from the lamp housing 214 to the material of the enclosure 212 where the heat is dissipated.

According to one embodiment of the invention, the cooling device contains TE cooler 242 and the controller 250 is configured for monitoring the temperature of the lamp housing 214 using the temperature sensor 220, and the controller 250 can vary the DC power applied to the TE cooler 240 to maintain the temperature of the lamp housing 214 in a predetermined temperature range.

Figure 2D:
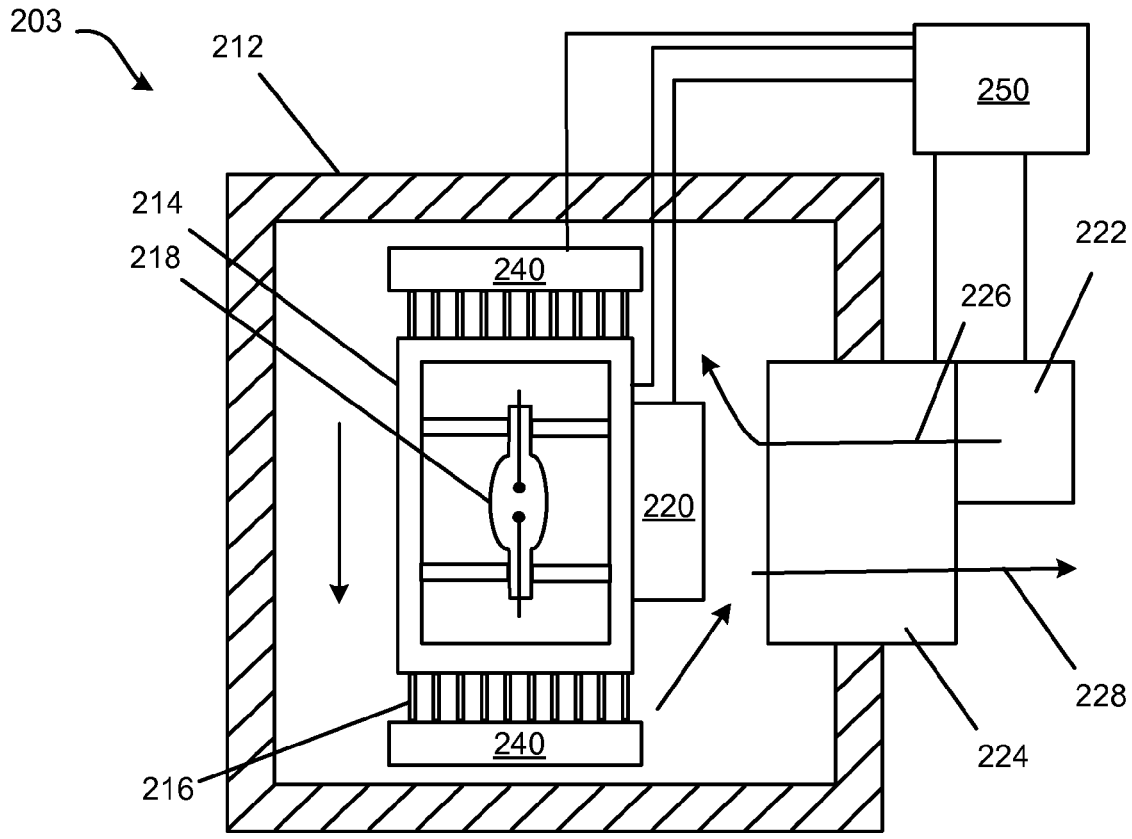

FIG. 2D schematically shows a cross-sectional view of a lamp temperature control system for an optical metrology system according to yet another embodiment of the invention. The lamp temperature control system 203 includes many of the components and functions of the lamp temperature control systems 200 and 202 described in FIGS. 2 and 3, respectively. The lamp temperature control system 204 combines functions of the TE cooler 240, the variable cooling fan 222, and the air duct 224 for controlling the temperature of the lamp housing 214.

According to an embodiment of the invention, the controller 250 is configured for monitoring the temperature of the lamp housing 214 using the temperature sensor 220, and controlling applied DC power to the TE cooler 240 and controlling the current and voltage used to power the variable cooling fan 222 to maintain the temperature of the lamp housing 214 in a predetermined temperature range. According to another embodiment of the invention, the controller 250 is configured for monitoring the temperature of the lamp housing 214 using the temperature sensor 220, and controlling applied DC power to the TE cooler 240 and controlling the conductance of the air duct 224 to vary the airflow 226 entering the enclosure 212 and the airflow 228 exiting the enclosure 212. According to another embodiment of the invention, the controller 250 is configured for monitoring the temperature of the lamp housing 214 using the temperature sensor 220, controlling the current and voltage used to power the variable cooling fan 222, controlling applied DC power to the TE cooler 240, and controlling the conductance of the air duct 224 by varying the airflow 226 entering the enclosure 212 and airflow 228 exiting the enclosure 212 to maintain the temperature of the lamp housing 214 in a predetermined temperature range.

Figure 2E:
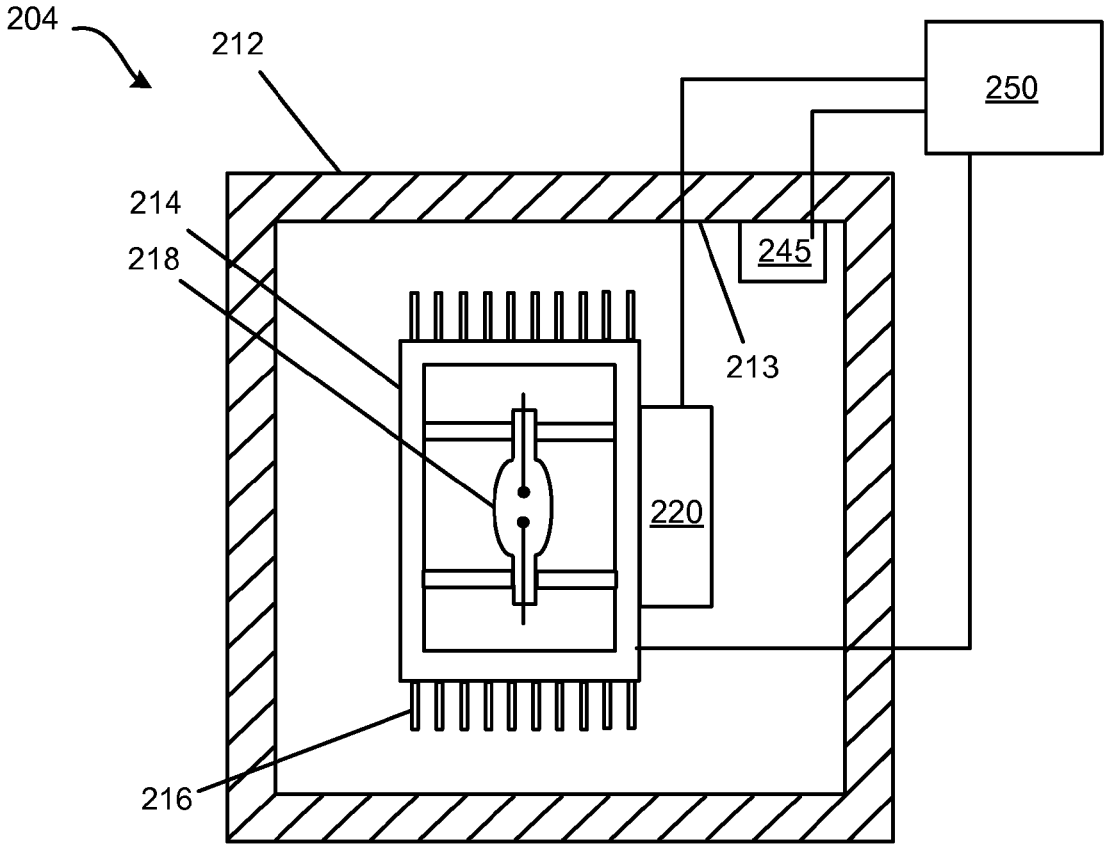

FIG. 2E schematically shows a cross-sectional view of a lamp temperature control system for an optical metrology system according to still another embodiment of the invention. The lamp temperature control system 204 is similar to the lamp temperature control system 201 described in FIG. 2B but in the embodiment depicted in FIG. 2E, a TE cooler 245 physically attached and thermally coupled to the inside surface 213 of enclosure 212 to control the temperature of the environment inside the enclosure 212. As those skilled in the art will realize, the TE cooler 245 may be physically coupled to any portion of the inside surface 213 of the enclosure 212 or other surfaces inside the enclosure 212. Alternatively, the TE cooler 245 may be imbedded in the material of the enclosure 212.

Still referring to FIG. 2E, according to an embodiment of the invention, the controller 250 is configured for monitoring the temperature of the lamp housing 214 using the temperature sensor 220, and controlling applied DC power to the TE cooler 245 to maintain the temperature of the lamp housing 214 in a predetermined temperature range.

Figure 2F:
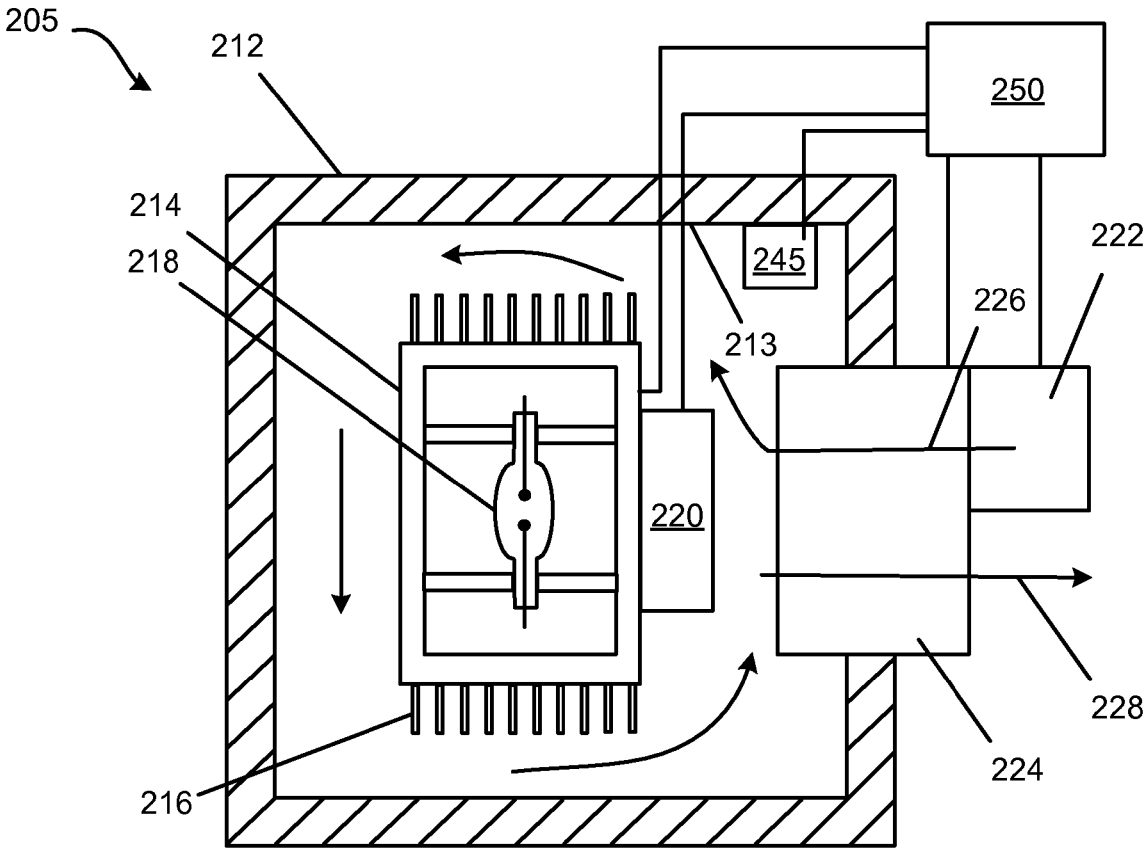

FIG. 2F schematically shows a cross-sectional view of a lamp temperature control system for an optical metrology system according to another embodiment of the invention. The lamp temperature control system 205 is similar to the lamp temperature control systems 200 and 204 described in FIGS. 2A and 2E, respectively, and combines functions of a TE cooler 245 inside and physically coupled to the enclosure 212, and the variable cooling fan 222 and/or the air duct 224 for controlling the temperature of the lamp housing 214.

Still referring to FIG. 2F, according to an embodiment of the invention, the controller 250 is configured for monitoring the temperature of the lamp housing 214 using the temperature sensor 220, and controlling applied DC power to the TE cooler 245 and controlling the current and voltage used to power the variable cooling fan 222 to maintain the temperature of the lamp housing 214 in a predetermined temperature range. According to another embodiment of the invention, the controller 250 is configured for monitoring the temperature of the lamp housing 214 using the temperature sensor 220, and controlling applied DC power to the TE cooler 245 and controlling the conductance of the air duct 224 to vary the airflow 226 entering end exiting the enclosure 212. According to another embodiment of the invention, the controller 250 is configured for monitoring the temperature of the lamp housing 214 using the temperature sensor 220, controlling the current and voltage used to power the variable cooling fan 222, controlling applied DC power to the TE cooler 245, and controlling the conductance of the air duct 224 to vary the airflow 226 entering the enclosure 212 and airflow 228 exiting the enclosure 212 to maintain the temperature of the lamp housing 214 in a predetermined temperature range.

Figure 2G:
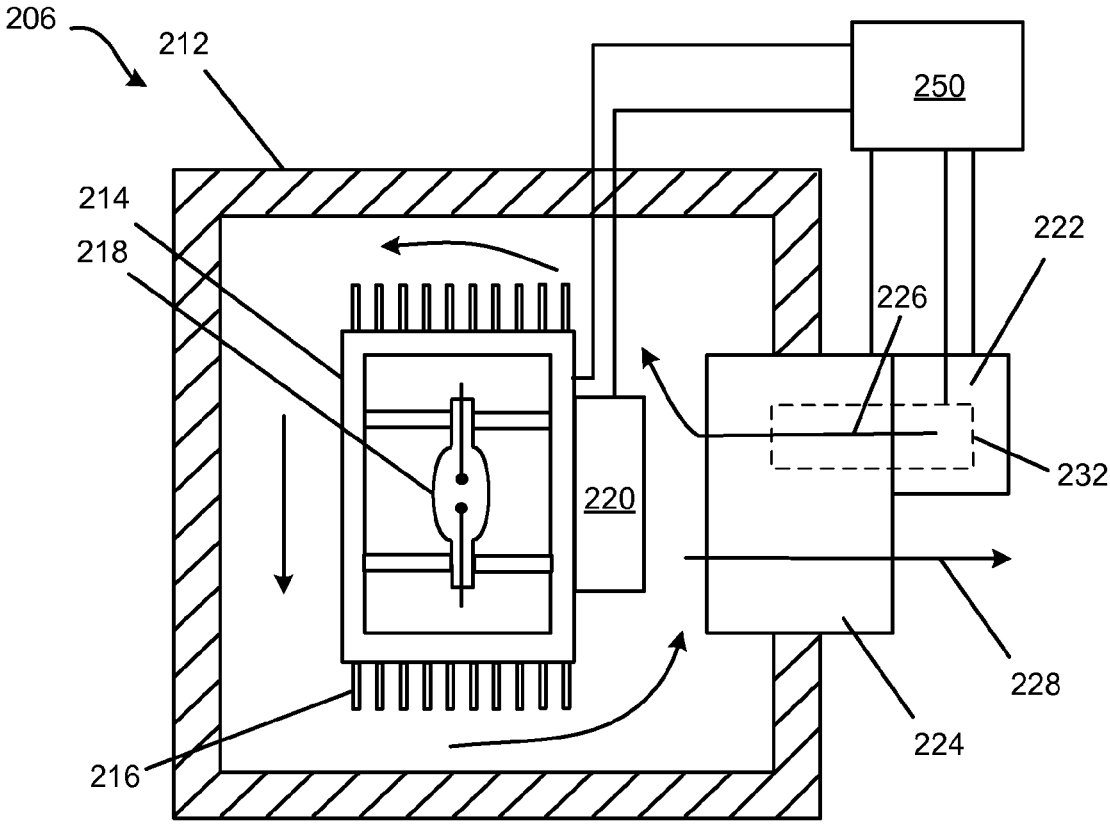

FIG. 2G schematically shows a cross-sectional view of a lamp temperature control system for an optical metrology system according to yet another embodiment of the invention. The lamp temperature control system 206 is similar to the lamp temperature control system 205 described in FIG. 2F but contains an air cooling device 232 that is configured for varying the temperature of the airflow 226 entering the enclosure 212. The air cooling device 232 may be integrated into the airduct 224 and/or integrated into the variable cooling fan 222. The air cooling device 232 may be a thermoelectric (TE) cooler, but other cooling devices may be used.

According to an embodiment of the invention, the controller 250 is configured for monitoring the temperature of the lamp housing 214 using the temperature sensor 220, controlling electrical power applied to the air cooling device 232 and controlling the current and voltage used to power the variable cooling fan 222 to maintain the temperature of the lamp housing 214 in a predetermined temperature range. According to another embodiment of the invention, the controller 250 is configured for monitoring the temperature of the lamp housing 214 using the temperature sensor 220, controlling the electrical power applied to the air cooling device 232 and controlling the conductance of the air duct 224 to vary the airflow 226 entering end exiting the enclosure 212. According to another embodiment of the invention, the controller 250 is configured for monitoring the temperature of the lamp housing 214 using the temperature sensor 220, controlling the current and voltage used to power the variable cooling fan 222, controlling electrical power applied to the air cooling device 232, and controlling the conductance of the air duct 224 to vary the airflow 226 entering the enclosure 212 and airflow 228 exiting the enclosure 212 to maintain the temperature of the lamp housing 214 in a predetermined temperature range.

Figure 2H:
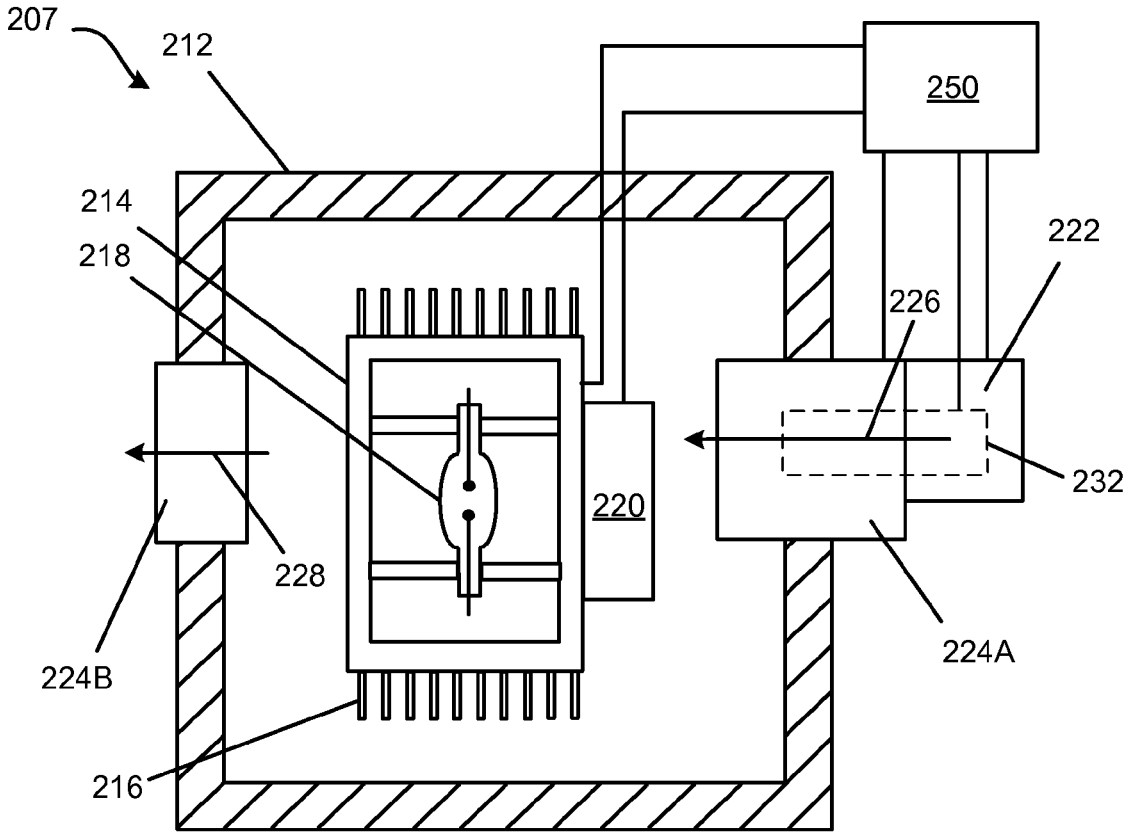

FIG. 2H schematically shows a cross-sectional view of a lamp temperature control system for an optical metrology system according to still another embodiment of the invention. The lamp temperature control system 207 is similar to the lamp temperature control systems 206 described in FIG. 2G. The embodiment depicted in FIG. 2H contains an inlet air duct 224A, and an exit air duct 224B at a location on the enclosure 212 that faces the location of the inlet air duct 224A on the enclosure 212. The lamp temperature control system 207 may thus act as wind tunnel. Those skilled in the art will readily appreciate that the relative positions of the inlet air duct 224A and the exit air duct 224B may be different than is shown in FIG. 2H. Further, the inlet air duct 224A and/or the exit air duct 224B may be simple openings in the enclosure 212 with constant conductances for the airflows 226 and 228

According to other embodiments of the invention, the lamp temperature control systems 200, 203, 205,206 depicted in FIGS. 2A, 2D, 2F, 2G, respectively, may be configured to contain an inlet air duct 224A and an exit air duct 224B as schematically shown in FIG. 2H.

It is to be understood that the lamp temperature control systems 200,201,202,203,204,205, 206, 207 depicted in FIGS. 2A-2H are shown for exemplary purposes only, as many variations of the specific components can be used to implement and practice embodiments of the present invention, and these variations will be readily apparent to one having ordinary skill in the art.

A method and apparatus for real time lamp temperature control for optical metrology have been disclosed in various embodiments. The embodiments are not intended to be exhaustive or to limit the invention to the precise forms disclosed. This description and the claims following include terms that are used for descriptive purposes only and are not to be construed as limiting. Persons skilled in the relevant art can appreciate that many modifications and variations are possible in light of the above teaching. For example, in one embodiment, the TE cooler 240 in FIG. 2D may be replaced with the TE cooler 242 of FIG. 2C. Persons skilled in the art will recognize various equivalent combinations and substitutions for various components shown in the Figures. It is therefore intended that the scope of the invention be limited not by this detailed description, but rather by the claims appended hereto.

What is claimed is:

1. A lamp temperature control system for an optical metrology system comprising:

an enclosure surrounding a lamp housing;

a lamp disposed in the lamp housing, wherein the lamp housing dissipates heat from the lamp;

a cooling device for cooling the lamp housing, wherein the cooling device comprises a thermoelectric (TE) cooler attached to the lamp housing and to an inside surface of the enclosure, the TE cooler configured for transferring heat from the lamp housing to the inside surface of the enclosure;

a temperature sensor coupled to the lamp housing for measuring the temperature of the lamp housing; and a controller for controlling the cooling device to maintain the temperature of the lamp housing in a narrow temperature range during operation of the lamp.

2. The system of claim 1, wherein the lamp comprises an ultraviolet (UV) lamp configured for emitting ultraviolet (UV) electromagnetic radiation, a lamp configured for emitting visible electromagnetic radiation, or a combination thereof.

3. The system of claim 1, wherein the cooling device further comprises a variable cooling fan configured for flowing air into the enclosure.

4. The system of claim 3, further comprising an air duct coupled to the enclosure and to the variable cooling fan, the air duct configured to control the flow of air from the variable cooling fan entering and exiting the enclosure.

5. The system of claim 3, wherein the cooling device further comprises an air cooling device configured for varying the temperature of the air flowing into the enclosure.

6. The system of claim 1, wherein the lamp housing comprises one or more cooling fins.

7. A method for controlling lamp temperature for optical metrology, the method comprising:

measuring temperature of a lamp housing containing a lamp using a temperature sensor coupled to the lamp housing;

cooling the lamp housing a cooling device, wherein the cooling further comprises removing heat from the lamp housing to the enclosure using a thermoelectric (TE) cooler attached to the lamp housing and to an inside surface of the enclosure; and controlling the cooling device to maintain the temperature of the lamp housing in a narrow temperature range during operation of the lamp.

8. The method of claim 7, wherein the lamp comprises an ultraviolet (UV) lamp configured for emitting ultraviolet (UV) electromagnetic radiation, a lamp configured for emitting visible electromagnetic radiation, or a combination thereof.

9. The method of claim 7, wherein the cooling further comprises flowing air into an enclosure containing the lamp housing a variable cooling fan configured for flowing the air into the enclosure.

10. The method of claim 9, wherein the cooling further comprises controlling the flow of air entering and exiting the enclosure using an air duct coupled to the enclosure and to the variable cooling fan.

11. The method of claim 9, wherein the cooling further comprises varying the temperature of the air flowing into the enclosure using an air cooling device.

12. The method of claim 7, wherein the lamp housing comprises one or more cooling fins.

13. A lamp temperature control system for an optical metrology system comprising:

an enclosure surrounding a lamp housing;

a lamp disposed in the lamp housing, wherein the lamp housing dissipates heat from the lamp;

a cooling device for cooling the lamp housing, wherein the cooling device further comprises a variable cooling fan configured for flowing air into the enclosure and an air cooling device configured for varying the temperature of the air flowing into the enclosure;

a temperature sensor coupled to the lamp housing for measuring the temperature of the lamp housing; and a controller for controlling the cooling device to maintain the temperature of the lamp housing in a narrow temperature range during operation of the lamp.

14. The system of claim 13, wherein the lamp comprises an ultraviolet (UV) lamp configured for emitting ultraviolet (UV) electromagnetic radiation, a lamp configured for emitting visible electromagnetic radiation, or a combination thereof.

15. The system of claim 13, further comprising an air duct coupled to the enclosure and to the variable cooling fan, the air duct configured to control the flow of air from the variable cooling fan entering and exiting the enclosure.

16. The system of claim 13, wherein the lamp housing comprises one or more cooling fins.

* * * * *